United States Patent [19]

Riley

[11] 4,215,481

[45] Aug. 5, 1980

[54] SHEET METAL DRAFTING DEVICE

[76] Inventor: Robert L. Riley, 1804 Weltin St., Orlando, Fla. 32803

[21] Appl. No.: 943,990

[22] Filed: Oct. 12, 1978

[51] Int. Cl.[3] ..... B43L 13/20

[52] U.S. Cl. ..... 33/174 N; 33/21 C

[58] Field of Search ..... 33/1 G, 1 B, 1 N, 21 C, 33/174 N, 75 R, 1 SB, 1 SD, 403, 476

[56] References Cited

U.S. PATENT DOCUMENTS

| | | | |
|---|---|---|---|
| 2,014,190 | 9/1935 | Simon | 33/1 N |
| 2,272,860 | 2/1942 | Wolfe | 33/75 R |
| 2,327,058 | 8/1943 | O'Keefe | 33/75 R |
| 2,653,387 | 9/1953 | Cameron | 33/174 N |
| 2,842,857 | 7/1958 | Whitten | 33/174 N |

FOREIGN PATENT DOCUMENTS

| | | | |
|---|---|---|---|
| 733260 | 5/1966 | Canada | 33/174 N |
| 904829 | 1/1954 | Fed. Rep. of Germany | 33/75 R |

*Primary Examiner*—John W. Shepperd

[57] ABSTRACT

This invention is a device which enables one to layout sheet metal elbows of many sizes, degree of angle, segments, and throat radiuses.

Further this invention is a device for laying out round pipe sections to intersect another round pipe at a right angle either on or off center of the pipe being intersected to form a sheet metal T joint of many sizes and combination of sizes.

Another advantage is the use of the transparent, rectangular, plastic elements, when one element is affixed upon the profile of an object to be intersected the lines required in this method of layout can be readily ascertained, thus eliminating the drafting of same.

The gist of this invention is a layout device, and method which enables one to layout hundreds of sheet metal objects in much less time and without the preliminary procedures which are often used in this type of sheet metal fabrication.

2 Claims, 8 Drawing Figures

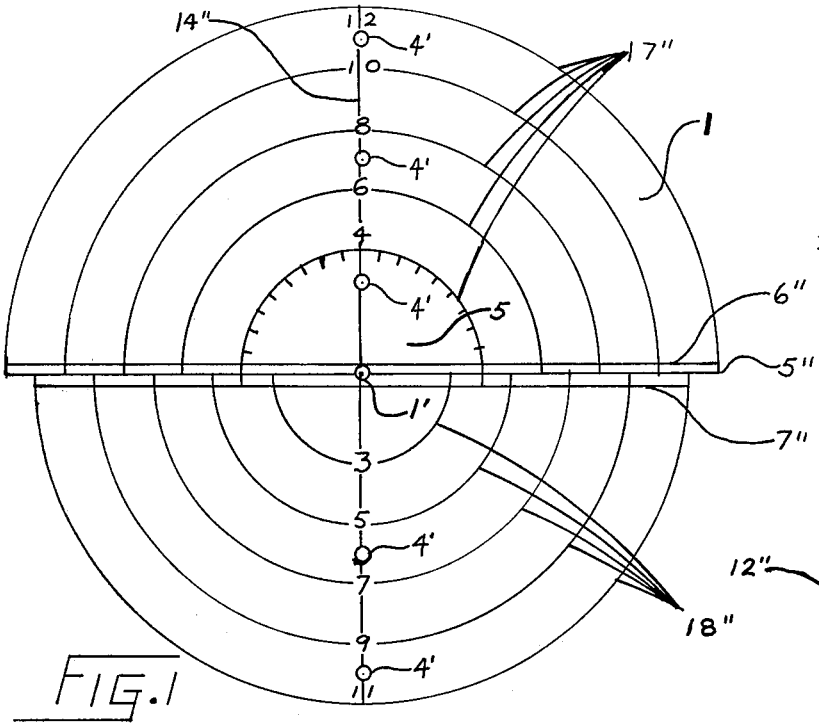
FIG. 1
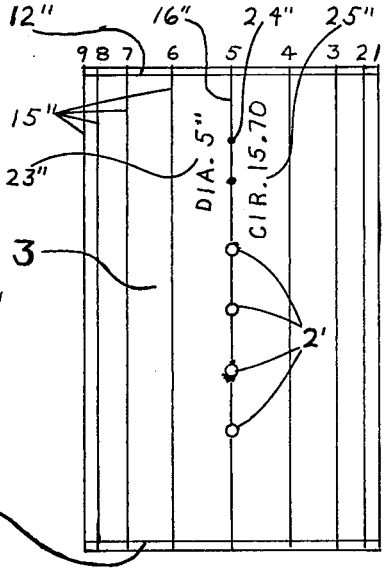
FIG. 3
FIG. 4
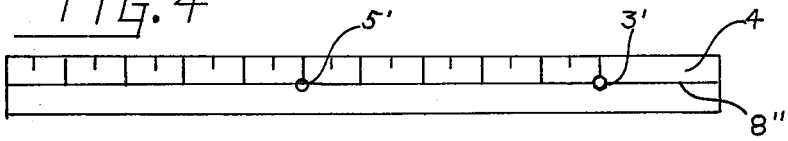
FIG. 2
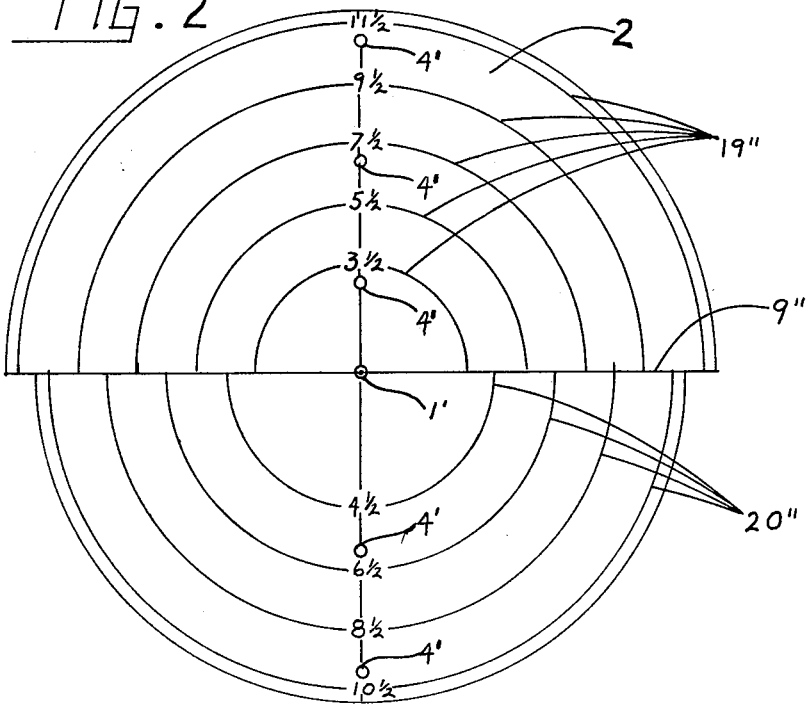

SHEET METAL DRAFTING DEVICE

An object of this invention is to provide an instrument for the purpose of expediting the layout time, and eliminating the preliminary procedure of laying out sheet metal elbow patterns of different sizes, angles, segments, and throat radiuses.

Another object is to provide a layout method not unlike the present procedure of laying out T joint patterns, only that the end view elevation of the T joint can be easily ascertained by pivotally connecting the required rectangular, plastic element on the obverse or reverse side of the disk so the lines on the rectangular element intersects the proper concentric circular arc of the disk, thus eliminating the common procedure of drafting an end view elevation of a T joint for the purpose of obtaining lines with which to layout the end of a round pipe to intersect another round the same size or larger, either on or off center of the pipe being intersected.

If the instrument is to be used for laying out templates for segments of an elbow, the required transparent, rectangular, plastic piece can be pivotally connected to the obverse side of the disk, together with the narrow plastic ruler, at a required degree on the protractor. This procedure is required, but it will eliminate the present method which necessitates the procedure of laying out a side profile of the elbow desired, scribing a concentric, circular arc, which is then divided into a number of equally spaced points, which are to be projected upward through the side profile of the elbow, which would produce the lines needed in the procedure of layout out an elbow template.

A description and numbering of the various elements of this invention are as follows;

FIG. 1 is a plan view of the obverse side of the disk, with a protractor imprinted thereon.

FIG. 2 is a plan view of the reverse side of the disk.

FIG. 3 is a plan view of one of a number of clear plastic elements.

FIG. 4 is a plan view of the narrow, clear plastic ruler.

Figure 8:
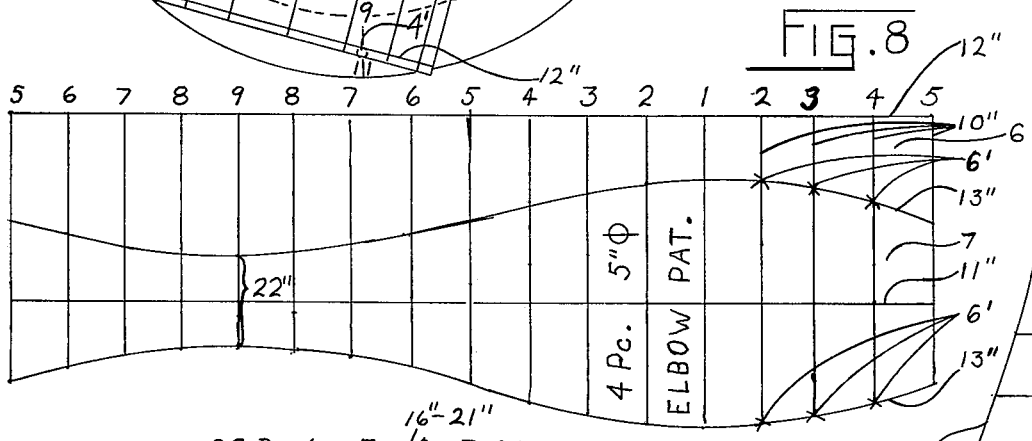

FIG. 8 indicates for illustration a form of elbow segments which can be laid out with the use of this instrument.

Figure 7:
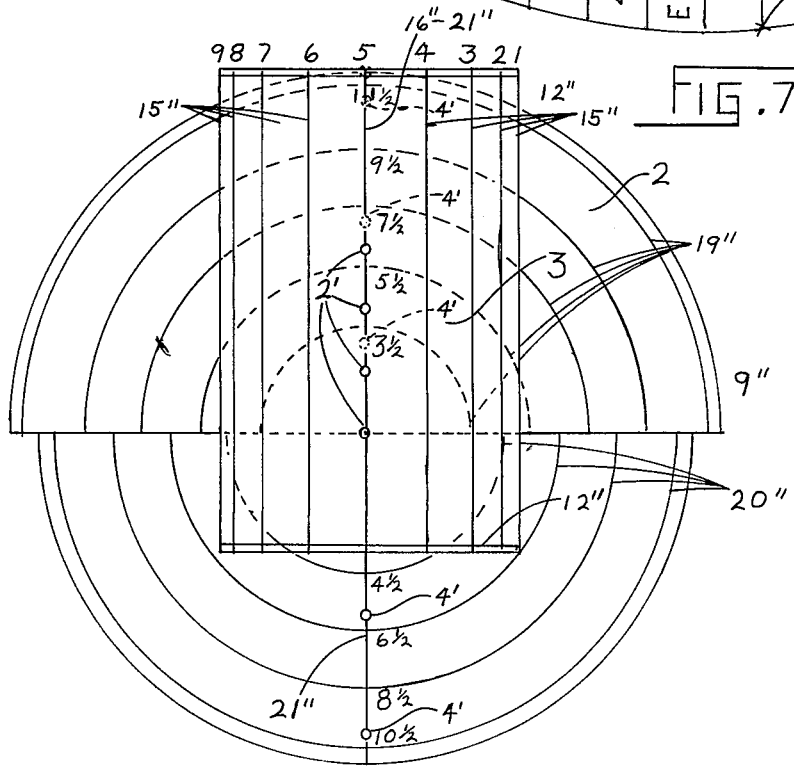

FIG. 7 is a plan view of the element of FIG. 2 with the element of

FIG. 3 pivotally connected in the proper position which enable a person to layout a 5" round pipe intersection a 7½" round pipe at a right angle.

Figure 5:
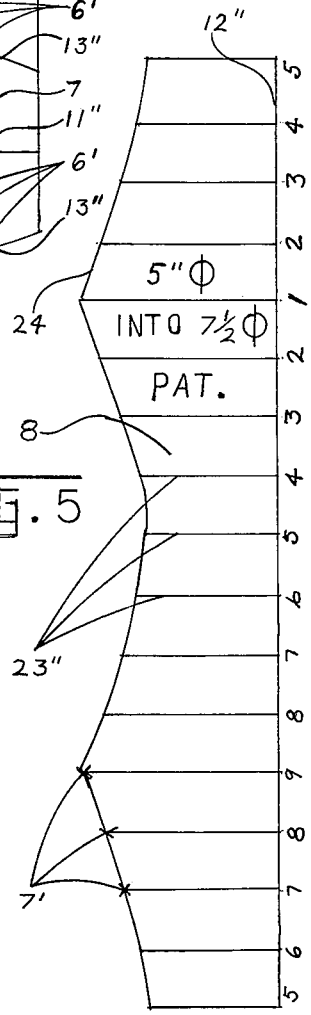

FIG. 5 indicates for illustration a form of round pipe segment for a T joint which can be laid out with the use of this instrument.

Referring to the drawing of FIG. 1, I have used the reference numeral 1 to designate the obverse side of the disk of metal and/or plastic. This side of the disk is divided in halves by a horizontal red line 5", two black lines 6" and 7" which run parallel with one each side of line 5", a black line 14" runs perpendicular to line 5", a series of holes spaced on 14" which I designate as 4', and a hole centered on the disk which is referred to as 1'. The upper half of 1 is imprinted with a plurality of concentric semi-circular arcuate lines 17" of even whole number sizes, each representing a diameter of round pipe, a protractor 5 is imprinted on this half of 1 with the base line upon the red line 5". The lower half of 1 has a plurality of concentric semi-circular arcuate lines 18" of uneven whole number sizes, each representing a diameter of round pipe.

The reverse side of the disk FIG. 2 I have used the reference numeral 2, this side of the disk 2 is divided into halves horizontally by a black line 9", and vertically by a black line 21", both lines crossing at a common center 1". The upper half of 2 is imprinted with a plurality of concentric semi-circular arcuate lines 19" of uneven half sizes, each representing a diameter of round pipe. The lower half of 2 is imprinted with a plurality of concentric semi-circular arcuate lines 20" of even half sizes, each representing a diameter of round pipe. The spaced holes on the perpendicular line 21" are numbered 4'.

The rectangular element of FIG. 3 is referred to as number 3 and is of a transparent, plastic material having a plurality of spaced parallel lines 15" extending longitudinally representing equally spaced lines on a pipe surface curved transversely to said lines. Line 16" being the center line, with a series of spaced holes 2. Lines 12" near each end of element 3 are to provide a suitable means of picking up lines 15" and 16" to be transferred to layouts such as 6, 7, and 8. This procedure will be explained later in this article. Each element 3 is imprinted with the diameter 23", the circumference 25", and the graduating points to encircle a pipe of that diameter 24" which are 1 to 9 to 1.

The element of FIG. 4 is numbered as 4, it is a clear plastic ruler with a red line 8" imprinted horizontally, a hole 3' two inches from one end to pivotally connect the ruler 4 to the obverse side of the disk 1, the hole 5' is for the convenience of storing this instrument.

Figure 6:
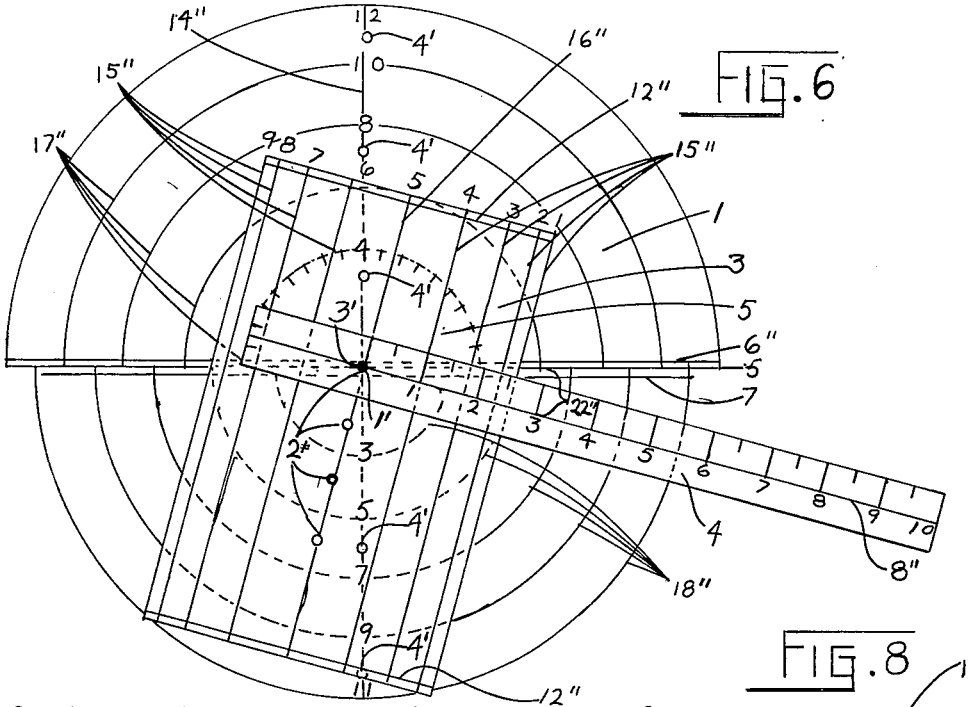
FIG. 6 is a plan view of the instrument with a combination of the elements of FIG. 1, FIG. 3, and FIG. 4 pivotally connected on the protractor at 15°, which is the proper setting to enable a person to layout a four piece 90° elbow.

FIG. 6 and FIG. 8 are detailed drawings of the layout device and the procedure used to layout an elbow pattern of a specific degree of bend, diameter, number of segments, and throat radius. For an example, FIG. 6 is how elements 3 and 4 are connected by a means to the obverse side of the disk 1 atop the protract 5 to aid in the process of laying out a 5 inch round elbow, having 90° of curvature, four segments, and a 3 inch throat radius. Element 3 is set on 5 at 15° from the vertical line 14".

Element 4 is then pivotally mounted atop the protractor 5 at 15° above horizontal, which is also the red line 5" on the obverse side of the disk 1.

The procedure of laying out templates for an elbow is shown in FIG. 8 elements 6 and 7 are as follows, a length of material equal to the circumference of a 4 inch round pipe is inscribed on one end with a horizontal line 12" which represents the line 12" of element 3, from this line a number of equally spaced parallel lines 10" are extended longitudinally there of representing equally spaced lines on a pipe surface. For this layout the lines 10" are numbered 5 to 9 to 1 to 5. The total of these lines 10" are equal to the circumference of a 5 inch round pipe. With the use of drafting dividers the points 15" and 16" of element 3 between the base line 12" and the black line 6" of the disk 1, may be transferred to the corresponding numbered line 10" of element 6, the points 6' on the lines 10" are now joined by a symmetrical curve 13". The shape of this template is referred to as a fish tail pattern, the seam is on the side of the finished segment, not at the throat or heel. To determine the layout procedure of the center section 7 of the elbow template, the points 22" at a right angle from the red line 8" of the plastic ruler 4 to the red line 5" of the disk 1 may be transferred to line 9 of the stretch out 6, then draw the horizontal line 11" and duplicate all points 6" below this line, and join by a symmetrical curve 13". This procedure produces two segments of a five inch round elbow, having 90°0 of curvature, four segments, and a 3 inch throat radius.

When it is necessary to layout a template for a T joint, the end of a round pipe intersecting a round pipe at a right angle, the same size or larger, an element 3 piece is pivotally mounted on center of either the obverse 1 or reverse side 2 of the disk. But for this example we are laying out a 5 inch round pipe into a 7½ inch round pipe. A stretch out 8 is drawn, which is equal in length to the circumference of a 5 inch round pipe. From the base line 12" a plurality of equally spaced lines 23" ae extanded longitudinally representing equally spaced lines on a pipe surface. For convenience these lines are numbered 5 to 9 to 1 to 5, with the use of drafting dividers or a compass the lines 15" and 16" from 12" of element 3 to the 7½ inch concentric, semi circular arc may be transferred to the corresponding numbered lines 23" of the template stretch out 8, then the points 7' on the lines 23" may be joined by a symmetrical curve 24. When the template material is cut along the curved line 24 and formed round, a template is formed for a round pipe intersecting another round pipe at a right angle. Different widths of element 3 may be used in a combination with a desired concentric, semi circular arc, on center or off center of the diameter pipe being intersected.

Having described my invention I claim as new:

1. An instrument for establishing points of curved lines for the purpose of laying out segments of round sheet metal elbows of many different sizes, degree of angle, segments, and throat radiuses, consisting of a metal and/or plastic disk with concentric circular arcs of even and uneven whole sizes, a protractor, a red line running horizontally centered on the disk and the base line of the protractor, two black lines running parallel one on each side of the red line, a black line radiating from the center of the disk, dividing the disk into halves perpendicularly, imprinted on the obverse side of the disk, a series of holes spaced on the perpendicular line with one hole centrally located to pivotally connect one of a number of transparent, rectangular plastic elements with unequally spaced parallel longitudinal lines representing equally spaced lines on a pipe surface curved transversely to said lines, a line on each end of the rectangular elements to serve as a base line, a series of holes in the rectangular member running down the center line, the rectangular members represent round pipe of a like width, a transparent ruler with a red center line, a scale along the center line, and two holes in the center line wth means of pivotally connecting one of the holes in a rectangular element and the scale ruler to the center hole of the disk atop the protractor at a predetermined degree, the intersections of the unequally spaced lines from the base line of the rectangular element to a horizontal line on the disk will produce the lines needed in the procedure of laying out elbow templates.

2. An instrument for establishing points of curved lines for the purpose of laying out the ends of round pipe intersecting another round pipe at a right angle either on or off center of the pipe being intersected, of different sizes and combination of sizes, a layout device comprised of several size sets, each set being somewhat the same mechanically and materially, consisting of a number of disk with concentric circular arcs of even and uneven half sizes imprinted on the obverse side and even and uneven half sizes imprinted on the reverse side representing cross of the main pipe of different diameters, a black line line on each side of the disk radiating from the center of the disk dividing the disk in halves perpendicularly, a series of holes spaced on the perpendicular line to pivotally connect one of a number of transparent, rectangular, plastic elements of even and/or uneven widths representing round pipe of like widths, with unequally spaced parallel longitudinal lines representing equally spaced lines on a pipe surface curved transversely to said lines, a line on each end of the rectangular member to serve as a base line, a series of holes spaced on the center line of each rectangular member a means to pivotally connect one of the holes on a rectangular member to one of the holes in the disk at a predetermined setting such that intersections of the unequally spaced parallel lines from either base line to one of the concentric arcs represents the pipe profile of the end of a pipe intersecting a main pipe on and/or off center.

* * * * *